United States Patent [19]

Milberger

[11] 4,174,000

[45] Nov. 13, 1979

[54] METHOD AND APPARATUS FOR INTERFACING A PLURALITY OF CONTROL SYSTEMS FOR A SUBSEA WELL

[75] Inventor: Lionel J. Milberger, Spring, Tex.

[73] Assignee: FMC Corporation, San Jose, Calif.

[21] Appl. No.: 878,495

[22] Filed: Feb. 16, 1978

[30] Foreign Application Priority Data

Feb. 26, 1977 [GB] United Kingdom ..... 8218/77

[51] Int. Cl.[2] ..... E21B 33/035

[52] U.S. Cl. ..... 166/362; 166/363; 166/368; 137/236 S

[58] Field of Search ..... 137/236; 166/368, 338, 166/339, 362–366; 251/26

[56] References Cited

U.S. PATENT DOCUMENTS

| | | | |
|---|---|---|---|
| 3,865,142 | 2/1975 | Begun et al. | 137/236 X |
| 3,894,560 | 7/1975 | Baugh | 166/368 X |
| 3,921,500 | 11/1975 | Silcox | 166/338 X |

*Primary Examiner*—Ernest R. Purser

*Attorney, Agent, or Firm*—L. B. Guernsey; W. W. Ritt, Jr.; J. F. Verhoeven

[57] ABSTRACT

A system for controlling a plurality of subsea wellhead operators provides a dual set of operator controls having an electrical control cable and a pair of hydraulic control lines from the wellhead to a control center at the surface of the water. A primary set of electro-hydraulic multiplexed controls and a back-up set of hydraulic controls are each mounted in a separate control module on a base near the Christmas tree. When the primary set of controls fails operation is changed to the back-up set of controls by a signal from the surface control center. Defective control modules can be changed without removal of the tree cap as the controls are all outside the Christmas tree. Also, a defective primary control module can be removed while the back-up control module continues to control the operators in the Christmas tree.

16 Claims, 4 Drawing Figures

METHOD AND APPARATUS FOR INTERFACING A PLURALITY OF CONTROL SYSTEMS FOR A SUBSEA WELL

BACKGROUND OF THE INVENTION

1. Field of the Invention

This invention relates to subsea control systems and more particularly to systems for positive control of underwater Christmas tree operations.

2. Description of the Prior Art

The production of oil and gas from offshore wells is well known in the petroleum industry. Wells are commonly drilled several hundred or even several thousand feet below the surface of the ocean. These wells must not only be drilled without the use of divers at the greater depths, but the connecting, testing and servicing of pipes and the operation of regulating valves must be performed on these wells during and after the drilling process.

It is well known to use surface controlled Christmas trees mounted at the wellhead of these undersea wells to control production in such wells. Such Christmas trees include specific-function operating valves which control the actual flow of oil from the well through a flowline to a storage device at the ocean surface. These Christmas tree valves can be controlled by hydraulic control systems, by electrical systems or by a combination of electrical and hydraulic control systems. In any of these systems it is desirable to use as few control lines as possible between a surface control center and the Christmas tree.

It is also desirable that a back-up control system be provided in case of a failure of the primary control system. Any failure of a single control system would be expensive because of lost production and because of the expense of the equipment needed to do the repairs. A back-up system can prevent shutdown of production and may allow repairs to be made at a more convenient time. The back-up system generally extends the usable life of the control system.

One such dual control system is shown in the U.S. Pat. No. 3,894,560 to Baugh. However, the shuttle valves which control the valve operators are enclosed in the tree cap of the Baugh apparatus. Thus, the tree cap must be removed and the tree opened to expose the working parts of the tree to sea water and corrosion in the well in order to replace these valves. Also the Baugh apparatus includes a single control module.

What is needed is a control system wherein the primary control module can be replaced while the back-up control module continues to operate the Christmas tree valves. It would also be advantageous to position the shuttle valves so that they could be replaced without removal of the tree cap.

SUMMARY OF THE INVENTION

The present invention overcomes some of the disadvantages of the prior art by using a pair of control modules each of which can control the operations of a subsea Christmas tree and each of which can be independently removed for repair or replacement. All of the valves and switches which control the operation of the Christmas tree valve operators are located in the control modules so these valves and switches can be replaced without removal of the Christmas tree cap. The primary control module can be removed while the back-up control module continues to control the operations of the Christmas tree.

DESCRIPTION OF THE PREFERRED EMBODIMENT

Figure 1:
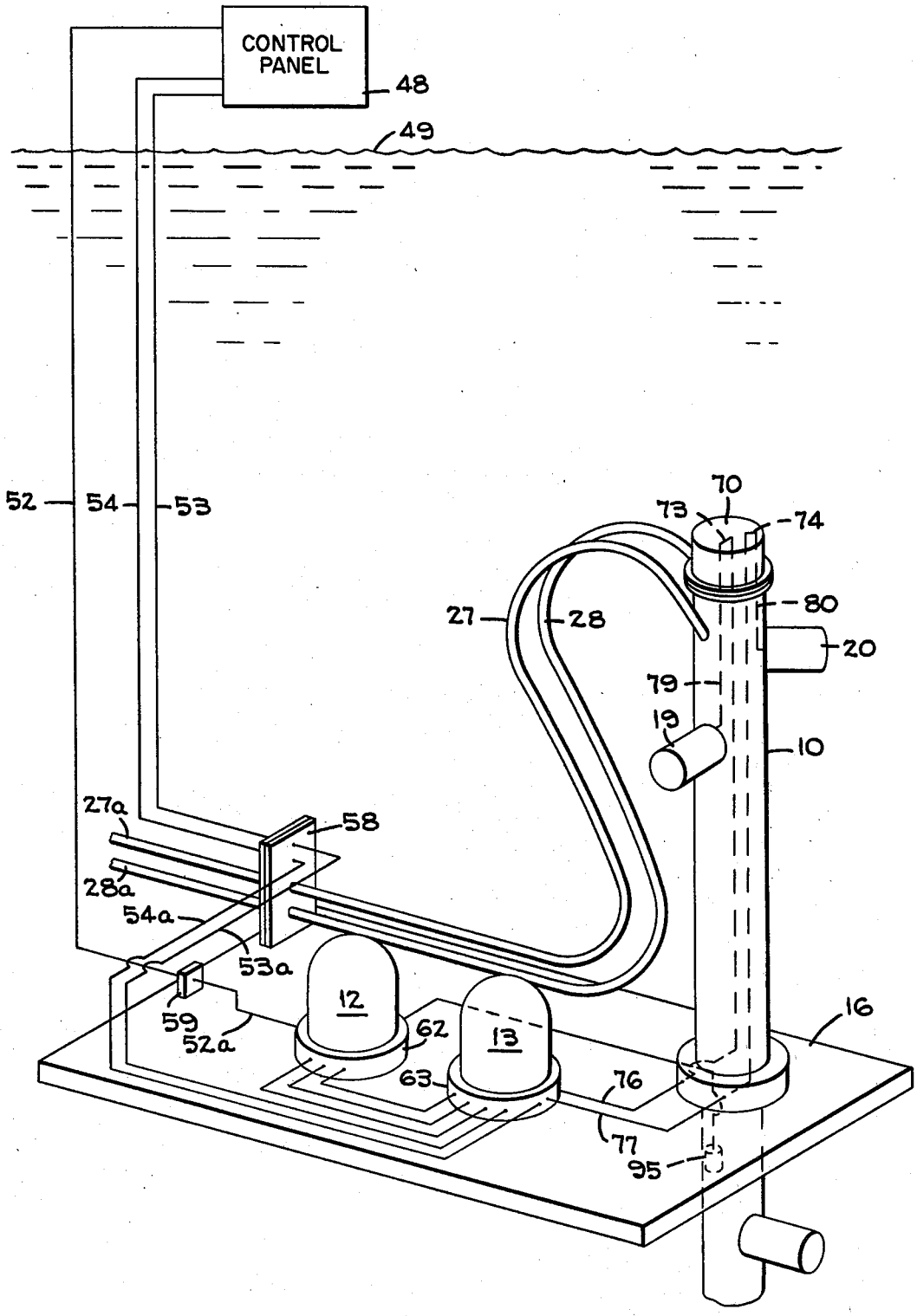
FIG. 1 is a perspective view of a subsea Christmas tree and the control apparatus of the present invention.

A method of interfacing a plurality of control systems for a subsea well comprises a subsea Christmas tree 10 (FIG. 1) and a pair of control modules 12, 13 mounted on a mounting plate 16. A pair of valve operators 19, 20 (FIGS. 1 and 2) control the operation of a pair of christmas tree valves 23, 24 (FIG. 2) to control the flow of oil from the Christmas tree through a pair of flowlines 27, 28 (FIGS. 1 and 2) which are connected to the christmas tree. The flowlines are each in the form of a loop (FIG. 1) having sufficient radius so that conventional "through-flow-loop" tools (not shown) can pass through the flowlines.

The primary control module 12 (FIG. 2) contains an electronics unit 31 for operating a pair of hydraulic control valves 32, 33 which are coupled to a hydraulic accumulator 36. The back-up control module 13 (FIG. 2) contains a plurality of hydraulic control valves 39–43 connected to a hydraulic accumulator 44 and a pair of shuttle valves 45, 46. The control modules 12, 13 are filled with oil and pressure compensated to prevent sea water from entering and damaging the inside components.

The subsea control system includes a control panel 48 which is schematically illustrated as mounted above the water line 49 and connected to the control modules by an electrical cable 52 and a pair of hydraulic lines 53, 54. The hydraulic line 53 provides the hydraulic control signals to operate the various control valves 39–43, while the hydraulic line 54 provides hydraulic fluid under pressure to power the valve operators 19, 20. The electrical cable 52 may contain a plurality of wires to couple a plurality of signals from the control panel 48 to the subsea electronics unit 31 or a multiplex system can be used with signals being sent sequentially on a single pair of wires between the control panel 48 and the electronics unit 31.

The flowlines 27, 28 and the hydraulic lines 53, 54 are connected to the respective lines **27*a*, 28*a*, 53*a*, 54*a* by a stab type of connector at a flowline connector block 58 so that the Christmas tree can be removed for reworking if necessary. The electrical cables 52, 52*a* are connected at a connector block 59**.

The control modules 12, 13 (FIGS. 1 and 2) are each mounted on a connector base 62, 63 having a plurality of stab hydraulic connectors 66 for connecting the hydraulic lines to the control modules. In order to ensure long trouble-free operation metal seals can be included in each of the connectors 66. The control module 12 includes a pair of stab cable connectors 67 to connect the cables **52*a*, 55*a* to the electronics unit 31. It is preferred that an inductive type of electrical connector 67** be used to reduce the possibility of a poor electrical connection due to corrosion. It may also be more convenient to mount the control module 12 atop the control module 13 rather than mounting them side-by-side as shown in the FIGS. 1 and 2.

A tree cap 70 (FIGS. 1 and 2) contains a plurality of hydraulic loops 73, 74 (FIG. 2) to connect a plurality of hydraulic supply lines 76, 77 from the control module 13 to a plurality of hydraulic operator lines 79, 80 in the Christmas tree 10. An advantage of extending the operator lines to the tree cap is that a production riser can be easily connected to the top of the Christmas tree while the tree cap is removed and hydraulic lines from the riser can be stabbed into the upper ends of the lines 79, 80 to provide hydraulic control of the valve operators 19, 20 during tree installation and during workover operations.

The shuttle valves 45, 46 (FIG. 2) are two-way hydraulic control valves of the type commonly used in the hydraulic control art. The shuttle valve 45 includes a pair of input ports 83, 84 and an output port 85 which is connected to hydraulic supply line 76. When a fluid input signal is received at the input port 83 a check ball 82 moves to block the input port 84 while the shuttle valve 45 provides a fluid output through the output port 85. Similarly, the shuttle valve 45 provides a fluid output through the output port 85 when an input signal is received on the input port 84 by moving the check ball 82 to block the input port 83.

The hydraulic control valves 39–43 are pressure sensitive and each operates in a deenergized position when the pressure on the signal input line **53*a* is less than the pre-set value indicated near each of the valves 39–43 (FIG. 2), for example, the valve 41 is deenergized when the pressure on the line 53*a* is less than 300 psi. Each of the control valves 32, 33, 39–43 is shown in the deenergized position. The valves 32, 33 are each moved to the energized position by an electrical signal on a respective signal input lead 88, 89. When a valve is energized the internal portion of the valve slides sideways (FIG. 2) a distance approximately equal to half the length of the internal portion. For example, when the valve 32 is energized the internal portion slides to the right until the input port 32*a* is coupled to the output port 32*b* by a passageway in the left half of the internal portion of the valve 32**.

When the primary control module 12 (FIG. 2) is used to control operation of the control valves 23, 24 in the Christmas tree the pressure on the signal line **53*a* is held below 300 psi so that all of the valves 39–43 in the back-up module 13 are deenergized. Fluid pressure from the hydraulic supply line 54*a* coupled through the deenergized valve 42 to a pressure input line 91 which is connected to the input ports 32*a*, 33*a* of the valves 32, 33. The valves 32, 33 are energized by electrical signals on the signal lines 88, 89 to control the valves 20, 19 respectively. For example, a signal on the line 89 energizes the valve 33, causing the input port 33*a* to connect to an output port 33*b* of the valve 33 and to the input port 84 of the shuttle valve 45, through the shuttle valve 45 to the output port 85 and to the valve operator 19 which operates the valve 23. In a similar manner a signal on the signal input lead 88 causes hydraulic pressure to be coupled through valve 32 and shuttle valve 46 to the valve operator 20 in the Christmas tree 10**.

If any portion of the control module 12 (FIG. 2) should fail to operate, control of the Christmas tree is switched to the back-up control module 13 by applying at least 300 psi on the hydraulic signal line **53*a* thereby energizing the control valve 41 in the control module 13. When the valve 41 is energized the pressure input line 54*a* is disconnected from the valves 32 and 33 and the pressure line 91 is connected to a vent 92 by the valve 41 to insure no pressure input to valves 32, 33. Fluid pressure can now be coupled from pressure line 54*a* to one of the valve operators 19, 20 in the tree 10 by one of the valves 39, 40, 42, 43**.

To operate the tree valve operator 19 (FIG. 2) a pressure signal between 500 psi and 1000 psi is applied on the signal line **53*a* to energize the valve 43 which couples the fluid pressure from line 54*a* through valves 42, 43, and shuttle valve 45 to the tree valve operator 19. When a pressure between 1000 psi and 1500 psi is applied on the signal line 53*a* the valve 42 is energized to open the circuit between the valve 43 and the shuttle valve 45, thereby deenergizing the tree valve operator 19. The tree valve operator 20 is also deenergized as the valves 39 and 40** are still deenergized.

To operate the tree valve operator 29 (FIG. 2) a pressure signal between 1500 psi and 2000 psi is applied on the signal line **53*a* to energize the valve 40 which couples the fluid pressure from the line 54*a*, through the valves 40, 39 and 46 to the tree valve operator 20. When a pressure over 2000 psi is applied on the signal line 53*a* the control valve 39 is energized, thereby deenergizing the tree valve operator 20. It is also possible to extend a single hydraulic line between the control panel 48 (FIG. 1) and the back-up control module 13 and connect this single hydraulic line to the hydraulic lines 53*a*, 54*a* (FIG. 2**).

Figure 2:
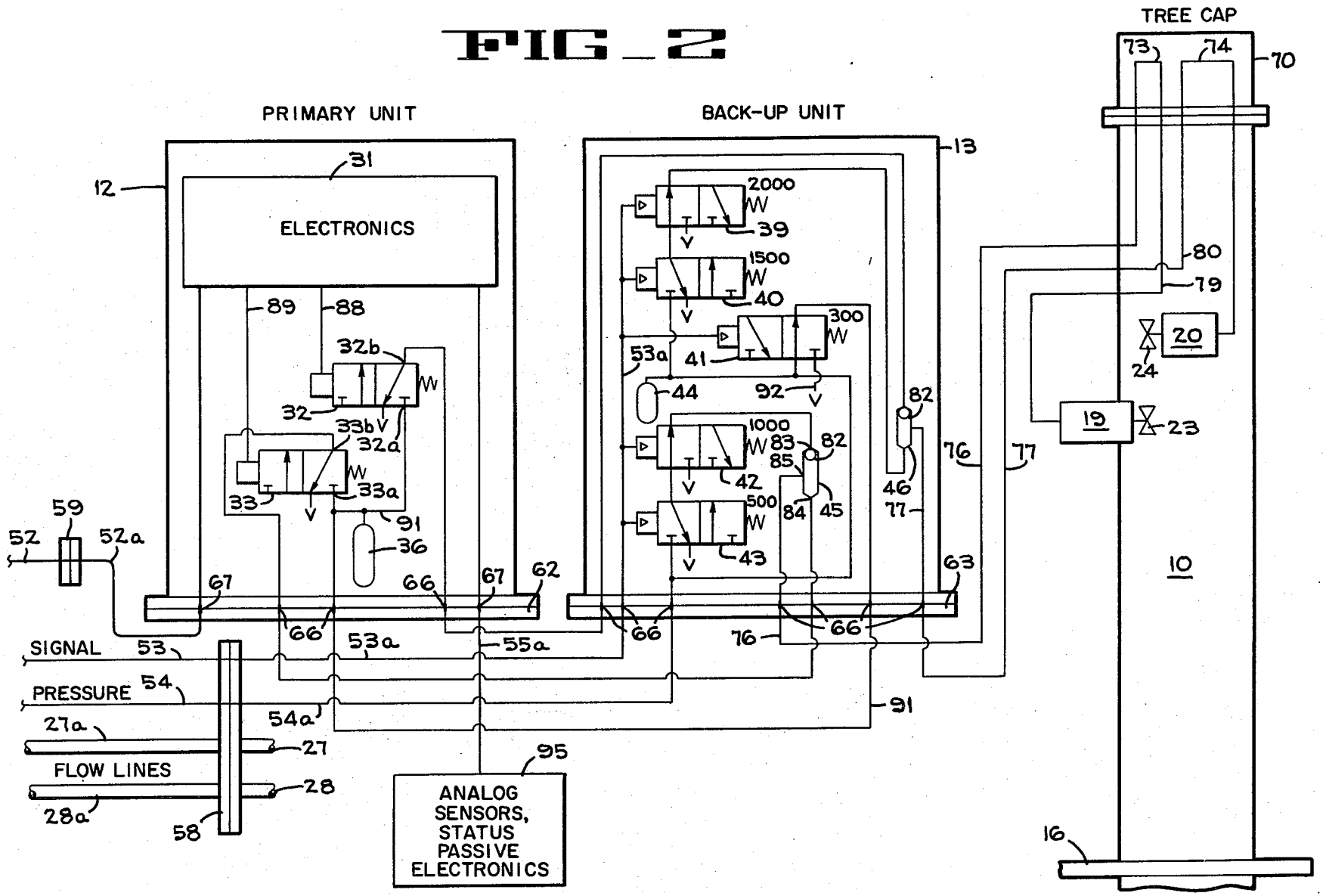
FIG. 2 is a schematic diagram of the control apparatus of FIG. 1.

An analog sensor 95 (FIGS. 1 and 2) provides valve status indication, temperature and pressure information from the Christmas tree 10 to the electronics unit 31 which, in turn, transmits this information to the surface control panel 48 (FIG. 1).

Figure 3:
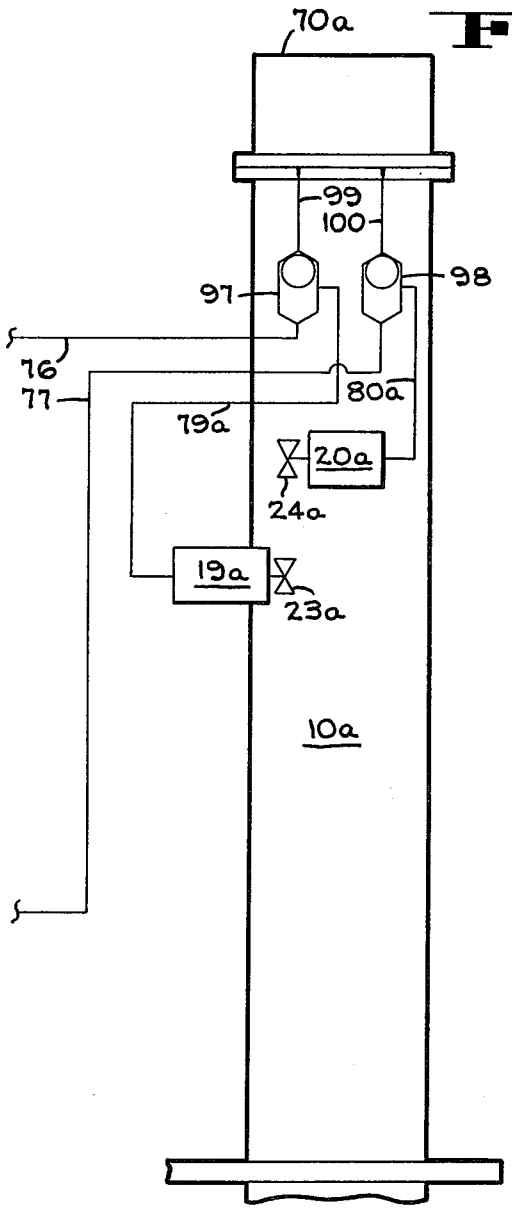
FIG. 3 is a diagram of another embodiment of a subsea Christmas tree which can be used with the control apparatus of the present invention.

Another embodiment of the Christmas tree portion of the present invention disclosed in FIG. 3 comprises a Christmas tree **10*a* having a pair of valve operators 19*a*, 20*a* to control the operation of a pair of Christmas tree valves 23*a*, 24*a*. The operation of the valves and the valve operators is similar to that of the valves 23, 24 and the valve operators 19, 20 of FIG. 2. However, a tree cap 70*a* (FIG. 3) does not contain the hydraulic loops 73, 74 disclosed in the tree cap 70 of FIG. 2. To permit control of the valve operators 19*a*, 20*a* by the control modules 12, 13 (FIG. 2) and by a completion riser which can be stabbed on to the top of the Christmas tree 10*a* when the tree cap is removed, a pair of shuttle valves 97, 98 are included in the Christmas tree. The output port of the shuttle valve 97 is connected to the valve operator 19*a* by a hydraulic line 79*a* and the input ports to the shuttle valve 97 are connected to the hydraulic lines 76 and 99. Thus, the valve operator 19*a* can be controlled by hydraulic fluid from either the control modules 12, 13 through the line 76 or by a completion riser connected to the hydraulic line 99. The output port of the shuttle valve 98 is connected to the valve operator 20*a* by a hydraulic line 80*a*, and the input ports are connected to the hydraulic lines 77 and 100. The valve operator 20*a* can also be controlled by either the control modules 12, 13 or by the completion riser connected to the hydraulic line 100**.

Figure 4:
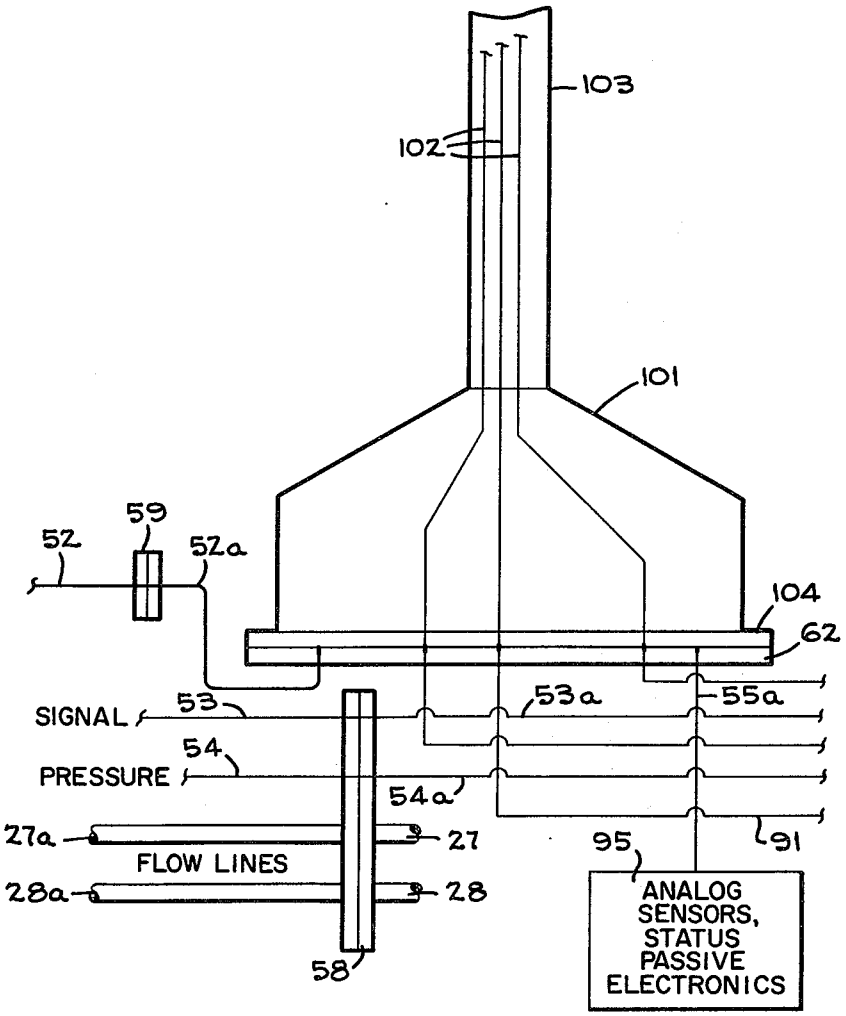
FIG. 4 is a diagrammatic view of a hose bundle stab sub used to provide direct control of the Christmas tree without using a primary control module.

A hose bundle stab sub 101 which can be used to provide surface control of the Christmas tree valve operators 19, 20 (FIG. 2) during workover operations or during the time the primary control module 12 is disabled is disclosed in FIG. 4. The hose bundle stab sub 101 includes a plurality of hydraulic lines 102 enclosed in a riser 103 and a connector base 104 adapted to connect to the connector base 62. The hydraulic lines 102 provide fluid under pressure to operate the shuttle valves 45, 46 (FIG. 2) and control the valve operators 19, 20. A similar hose bundle stab sub can also be adapted to replace the back-up control module 13 (FIG. 2) if the back-up module should be damaged and a replacement is not available.

The present invention provides a dual control for operation of the valve operators in a subsea Christmas tree and means for replacement of a primay control module without interruption of the operation of the Christmas tree.Hydraulic control lines from the control modules enter the Christmas tree 10 below the tree cap 70 and are routed up through the tree cap and back down into the Christmas tree. This allows easy connection to the valve operators from a completion riser which is connected to the top of the tree after the tree cap is removed. Having the control modules and the shuttle valves mounted outside the Christmas tree provides easy replacement of these components and also prevents possible damage to these components when workover operations are undertaken on the Christmas tree.

Although the best mode contemplated for carrying out the present invention has been herein shown and described, it will be apparent that modification and variation may be made without departing from what is regarded to be the subject matter of the invention.

What is claimed is:

1. Interfacing apparatus for dual control of a subsea Christmas tree having a plurality of valve operators for controlling a plurality of tree-mounted operating valves, said apparatus comprising:

a primary control module for normally operating said valve operators;

a back-up control module for back-up operation of said valve operators;

selection means for selectively connecting one of said primary control module and said back-up control module to said operating valves;

a surface control unit for controlling the operation of said primary control module and said back-up control module and for controlling said selection means to determine which one of said primary and said back-up control modules is coupled to said operating valves; and means for mounting said selection means, said primary control module and said back-up control module adjacent said Christmas tree to facilitate replacement of said primary control module, said back-up control module and said selection means without accessing said Christmas tree.

2. Interfacing apparatus as defined in claim 1 including a plurality of lines for carrying operating power to said valve operators, and means for connecting said lines between said valve operators and said selection means.

3. Interfacing apparatus as defined in claim 2 including a tree cap having a plurality of passageways therein, means for mounting said tree cap atop said Christmas tree and wherein at least a portion of said power carrying lines extend through said passageways in said tree cap and into said Christmas tree.

4. Interfacing apparatus as defined in claim 3 wherein said power carrying lines in said Christmas tree extend to the top portion of said Christmas tree for easy connection to a completion riser when said tree cap is removed, to enable said completion riser to control said valve operators when said tree cap is removed.

5. Interfacing apparatus as defined in claim 1 wherein said means for mounting said primary control module includes means for removable connecting said primary control module to said Christmas tree for removal and replacement while said back-up control module continues to operate said valve operators.

6. Interfacing apparatus for dual control of a subsea wellhead having a plurality of valve operators for controlling a wellhead valve system, said apparatus comprising:

an electro-hydraulic control module for normally operating said valve operators;

a hydraulic control module for back-up operation of said valve operators;

means for selectively connecting one of said electro-hydraulic control module and said hydraulic control module to said wellhead valve system;

a surface control unit for controlling the operation of said electro-hydraulic and said hydraulic control modules and for selecting the control module which operates said valve operators;

means for coupling control signals from said surface control unit to said valve operators when a tree cap is removed from said wellhead; and means for directing the operation of said hydraulic control module while said electro-hydraulic control module is being removed and replaced.

7. Interfacing apparatus as defined in claim 6 including means for connecting a production riser to control said valve operators when a tree cap is removed from said wellhead.

8. Interfacing apparatus as defined in claim 6 including means for mounting said electro-hydraulic control module, said hydraulic control module and said selective connecting means adjacent said wellhead to facilitate replacement of said modules and said selective connecting means without accessing said wellhead.

9. Interfacing apparatus as defined in claim 6 wherein said means for selectively connecting one of said control modules to said wellhead valve system includes at least one shuttle valve, and means for mounting said shuttle valve in one of said control modules.

10. Interfacing apparatus for dual control of a subsea Christmas tree having a plurality of valve operators for controlling a plurality of tree-mounted operating valves, said apparatus comprising:

a primary control module for normally operating said valve operators;

a back-up control module for back-up operation of said valve operators;

selection means for selectively connecting one of said primary control module and said back-up module to said christmas tree;

a tree cap having a plurality of hydraulic loops extending from the bottom of said tree cap up through said tree cap and returning to the bottom of the tree cap;

means for connecting a first end of each of said hydraulic loops in said tree cap to said selection means; and means for connecting a second end of each of said hydraulic loops in said tree cap to a corresponding one to said valve operators.

11. Interfacing apparatus for dual control as defined in claim 10 including means for mounting said selection means, said primary control module and said back-up control module adjacent said Christmas tree to facilitate replacement of said modules and said selection means without accessing said Christmas tree.

12. Interfacing apparatus for dual control as defined in claim 11 including a surface control unit for controlling the operation of said primary control module, said back-up control module and said selection means.

13. A method of interfacing a plurality of control systems between a surface-mounted control panel and a subsea wellhead having a plurality of valve operators in a Christmas tree at said wellhead, said method comprising the steps of:

(1) mounting a primary control module near said Christmas tree, said primary control module having a primary control valve for each of said valve operators, (2) mounting a back-up control module near said Christmas tree, said back-up control module having a back-up control valve for each of said valve operators, (3) providing selection means for selectively coupling each of said primary control valves or each of said back-up control valves to a corresponding one of said valve operators in said Christmas tree, (4) mounting said selection means near said christmas tree for easy replacement thereof without accessing said Christmas tree, (5) coupling selection signals between said control panel and said selection means to control the operation of said selection means, and (6) coupling control signal between said control panel and said primary control module or said back-up control module to operate the control valves which are coupled to said valve operators.

14. A method of interfacing as defined in claim 13 including the additional steps of:

mounting a tree cap atop said Christmas tree, and routing connecting lines through said tree cap between said valve operators and said selection means.

15. A method of interfacing as defined in claim 14 including the additional steps of:

providing means for connecting control lines from a completion riser to the connecting lines at the top of said Christmas tree when said tree cap is removed and said completion riser is lowered on to the top of said Christmas tree, removing said tree cap from the top of said Christmas tree, connecting said completion riser to the top of said tree, and using said control lines in said completion riser to control the operation of said valve operators.

16. A method of interfacing a plurality of control systems between a surface-mounted control panel and a subsea wellhead having a plurality of valve operators in a Christmas tree at said wellhead, said tree having a plurality of hydraulic supply lines connected to said tree, said method comprising the step of:

(1) mounting a primary control module near said Christmas tree, said primary control module having a primary control valve for each of said valve operators, (2) mounting a back-up control module near said Christmas tree, said back-up control module having a back-up control valve for each of said valve operators, (3) providing selection means for selectively coupling each of said primary control valves or each of said back-up control valves to a corresponding one of said hydraulic supply lines in said Christmas tree, (4) mounting a tree cap atop said Christmas tree, (5) routing a plurality of hydraulic loops through said tree cap with each of said loops connected between one of said hydraulic supply lines and a corresponding one of said valve operators, (6) mounting said selection means near said Christmas tree for easy replacement thereof without accessing said Christmas tree, (7) coupling selection signals between said control panel and said selection means to control the operation of said selection means, and (8) coupling control signal between said control panel and said primary control module or said back-up control module to operate the control valves which are coupled to said valve operators.

* * * * *